US007217310B2

(12) United States Patent
Yahagi et al.

(10) Patent No.: US 7,217,310 B2
(45) Date of Patent: May 15, 2007

(54) METAL POWDER FOR POWDER METALLURGY AND IRON-BASED SINTERED COMPACT

(75) Inventors: Masataka Yahagi, Ibaraki (JP); Toru Imori, Ibaraki (JP); Atsushi Nakamura, Ibaraki (JP); Yasushi Narusawa, Ibaraki (JP); Seiji Masuda, Ibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 35 days.

(21) Appl. No.: 10/514,274

(22) PCT Filed: Sep. 1, 2003

(86) PCT No.: PCT/JP03/11151

§ 371 (c)(1),
(2), (4) Date: Nov. 12, 2004

(87) PCT Pub. No.: WO2004/024372

PCT Pub. Date: Mar. 25, 2004

(65) Prior Publication Data

US 2005/0166709 A1 Aug. 4, 2005

(30) Foreign Application Priority Data

Sep. 10, 2002 (JP) ..... 2002-263940

(51) Int. Cl.
*B22F 1/00* (2006.01)
*B22F 3/00* (2006.01)

(52) U.S. Cl. ..... 75/246; 75/231; 75/252

(58) Field of Classification Search ..... 75/231, 75/252, 246

See application file for complete search history.

(56) References Cited

U.S. PATENT DOCUMENTS

| | | | | |
|---|---|---|---|---|
| 2,001,134 | A * | 5/1935 | Hardy | 419/36 |
| 2,307,343 | A * | 1/1943 | Whipple | 252/62.55 |
| 2,354,218 | A * | 7/1944 | Murray | 123/1 A |
| 2,593,943 | A * | 4/1952 | Wainer | 419/37 |
| 3,660,288 | A * | 5/1972 | Hansen | 508/521 |
| 4,834,800 | A * | 5/1989 | Semel | 106/403 |
| 5,415,791 | A * | 5/1995 | Chou et al. | 508/103 |
| 6,013,723 | A * | 1/2000 | Akao | 524/577 |
| 6,132,487 | A | 10/2000 | Mori | 75/247 |
| 6,261,336 | B1 * | 7/2001 | Behi et al. | 75/246 |
| 6,536,352 | B1 * | 3/2003 | Nadkarni et al. | 102/506 |

FOREIGN PATENT DOCUMENTS

| | | |
|---|---|---|
| JP | 61-034101 | 2/1986 |
| JP | 64-001522 | 1/1989 |
| JP | 06-290919 | 10/1994 |
| JP | 10-046201 | 2/1998 |
| JP | 2003-003201 | 1/2003 |

OTHER PUBLICATIONS

Patent Abstracts of Japan, 1 page English Abstract of JP 2003-003201, Jan. 2003.
Patent Abstracts of Japan, 1 page English Abstract of JP 04-176801, Jun. 1992.
esp@cenet database, 1 page English Abstract of JP 06-290919, Oct. 1994.
esp@cenet database, 1 page English Abstract of JP 64-001522, Jan. 1989.
esp@cenet database, 1 page English Abstract of JP 10-046201, Feb. 1998.
esp@cenet database, 1 page English Abstract of JP 61-034101, Jan. 1986.
Co-pending U.S. Appl. No. 10/526,295, filed on Mar. 1, 2005.

* cited by examiner

*Primary Examiner*—Ngoclan T. Mai
(74) *Attorney, Agent, or Firm*—Howson & Howson LLP

(57) ABSTRACT

Provided is metallic powder for powder metallurgy having iron as its principal component and containing indium soap, or metallic powder for powder metallurgy further comprising at least one type selected among bismuth soap, nickel soap, cobalt soap, copper soap, manganese soap and aluminum soap in such indium soap. Thereby obtained is metallic powder for powder metallurgy capable of easily improving the rustproof effect without having to hardly change the conventional process.

3 Claims, No Drawings

METAL POWDER FOR POWDER METALLURGY AND IRON-BASED SINTERED COMPACT

BACKGROUND OF THE INVENTION

The present invention pertains to mixed powder for powder metallurgy to be employed in the manufacture of sintered components, blushes and so on, and particularly to metallic powder for powder metallurgy and an iron-based sintered body suitable in manufacturing the likes of iron-based sintered components superior in rustproof performance to be used as a solid lubricant or the like.

Generally, iron powder used in the application of sintered mechanical components, sintered oil retaining bearings, metal graphite brushes and so on rusts easily, and is commonly used upon mixing an organic rust-prevention agent such as benzotriazole therein.

Nevertheless, although such an organic rust-prevention agent possesses a temporary rustproof effect, it decomposes or evaporates at 500° C. or higher, and becomes lost at an ordinarily employed sintering temperature of 700° C. or higher. Therefore, the same condition will occur unless rust prevention is performed after the sintering, and there is a problem in that the sintered object will rust easily.

Meanwhile, in order to obtain the rustproof performance after sintering, a proposal has been made to form a composite powder sintered body by mixing a slight amount of metal powder such as zinc, bismuth, lead or the like with sintering powder having iron as its principal component, or mixing the vapor thereof to the gas used during sintering.

However, this requires an additional step, the manufacturing process will become complex as a result thereof, and there is a problem in that there will be variations in the quality all that much more. Further, even if metal powder of bismuth or lead is mixed in, minute particles are merely dispersed, and it could not be said that it is evenly distributed. Further, since indium metal is a soft metal, it is difficult to make it into metal powder.

As a conventional additive agent for powder metallurgy, there is an additive agent having organic acid cobalt metallic soap as its component, and technology for manufacturing a sintered body by adding and mixing this additive agent 0.1 to 2.0% by weight, and then molding and sintering this mixed powder has been disclosed (c.f. Japanese Patent Laid-Open Publication No. H10-46201).

Moreover, technology of adding and mixing metal stearate to rare earth-iron-boron permanent magnet coarse powder, which is mainly composed in atomic % of rare earth element R (among rare-earth elements containing Y, one or two or more elements are combined) of 10 to 25%, boron B of 1 to 12%, and the remaining part consisting of iron Fe (a part of Fe is replaced at least with one or more kinds of elements selected from Co, Ni, Al, Nb, Ti, W, Mo, V, Ga, Zn and Si in a range of 0 to 15%, if necessary), and thereafter dry-pulverizing this mixture has also been disclosed (c.f. Japanese Patent Laid-Open Publication No. H6-290919).

Further, a molding improving agent of alloy powder for a permanent magnet consisting of at least one kind selected from polyoxyethylene alkyl ether, polyoxyethylene monofatty acid ester and polyoxyethylene alkylallylether compounded with at least on kind of stearate at 1/20 to 5/1 compounding ratio has also been disclosed (c.f. Japanese Patent Laid-Open Publication No. S61-34101).

SUMMARY OF THE INVENTION

An object of the present invention is to provide metallic powder for powder metallurgy capable of easily improving the rust-prevention effect without having to hardly change the conventional process, and an iron-based sintered body with a rustproof function obtained by sintering such metallic powder for powder metallurgy.

As a result of intense study to resolve the foregoing problems, the present inventors discovered that by mixing a specific additive material during molding of the sintering powder having iron as its principal component, an effect as a lubricant during molding can be yielded, and the rust-prevention effect of products after sintering could be significantly improved by dispersing the metal component evenly.

Based on this discovery, the present invention provides:

1. Metallic powder for powder metallurgy having iron as its principal component, characterized in containing indium soap;
2. Metallic powder for powder metallurgy according to paragraph 1 above, characterized in further comprising at least one type selected among bismuth soap, nickel soap, cobalt soap, copper soap, manganese soap and aluminum soap;
3. An iron-based sintered body with a rustproof function obtained by adding indium soap to metallic powder for powder metallurgy having iron as its principal component, and sintering this mixture; and
4. An iron-based sintered body with a rustproof function obtained by adding and sintering indium soap, and further adding and sintering at least one type selected among bismuth soap, nickel soap, cobalt soap, copper soap, manganese soap and aluminum soap.

DETAILED DESCRIPTION OF THE INVENTION

Upon devising the present invention, the present inventors focused attention on zinc stearate to be added in a slight amount as a lubricant upon forming powder. Nevertheless, this zinc stearate has a problem in that it dissipates during sintering, and damages the sintering furnace since it has high corrosiveness, and it has become evident that the rustproof effect is hardly any different from a case when it is additive-free.

As described above, in most cases, this zinc stearate is merely used as a lubricant upon molding, and materials were considered which possess an equal lubricant function as this zinc stearate and at the same time capable of increasing the rustproof effect unavailable in such zinc stearate.

Here, added to the metallic powder for powder metallurgy was metallic soap having a function as a molding lubricant equivalent to that of zinc stearate, which possesses suitable vapor pressure at the sintering temperature, and which is capable of improving the rustproof effect even after sintering.

As a result, the rustproof effect of a sintered body can be improved exponentially without having to significantly change the conventional manufacturing process of such sintered body.

It has become known that indium soap possessing suitable vapor pressure in this sintering temperature yields an extremely superior rustproof effect. Moreover, a similar rustproof effect could be obtained by further adding to this indium soap a soap selected from bismuth soap, nickel soap, cobalt soap, copper soap, manganese soap and aluminum soap.

Moreover, metallic soaps such as metallic soap stearate, metallic soap propionate and metallic soap naphthenate may be used as the soap.

Generally, it is desirable to add 0.1 to 2.0 parts by weight of such metallic soap to 100 parts by weight of metallic powder for powder metallurgy having iron as its principal component.

Nevertheless, this additive amount may be changed in accordance with the type of sintered body, and the additive amount does not necessarily have to be limited to the foregoing additive amount. In other words, the additive amount may be arbitrarily set within a range that is capable of maintaining the characteristics of the target sintered body.

Further, the metallic powder for powder metallurgy to which metallic soap is added does not necessarily have to be iron powder, and the present invention may be similarly applied to powder in which iron is coated on other metal powders or an iron-mixed powder for improving the rust-proof effect.

EXAMPLES AND COMPARATIVE EXAMPLES

Next, the present invention is described based on the Examples. The Examples are for facilitating the understanding of the invention, and the present invention is not in any way limited thereby. In other words, the present invention covers other Examples and modifications based on the technical spirit of the invention.

Example 1

Synthesized indium stearate (In content of 12.0 wt %) was pulverized, and this was put through a sieve to obtain fine powder of 250 meshes or less.

0.8 wt % of this indium stearate (abbreviated as "In" in Table 1 below) and 1.0 wt % of graphite powder were mixed with the iron powder (Hoganas-made: reduced iron powder). This mixed powder (fill of 15 to 2.5 g) was molded into a test piece of approximately 10.06 mm ϕ×2.70 to 4.55 mmH under a molding pressure of 6 t/cm$^2$.

In order to judge moldability, details of the relationship and the like of the molding density (GD) and molding pressure of the respective compacts are shown in Table 1 (Sample No. 291 to 298).

Evaluation on the moldability of the mixed powder was conducted with respect to the test piece, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 1.

This sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 1

| | | | | | Pressure | Before Sintering | | | | | After Sintering at 1150° C., 1 hr, H2 | | | |
|---|---|---|---|---|---|---|---|---|---|---|---|---|---|---|
| No. | Sample No. | Soap | Fill g | Pressure t · cm−2 | (Device Side) kgf · cm−2 | ϕ mm | t mm | w g | GD g/cc | Sintering Batch | ϕ mm | t mm | w g | SD g/cc |
| 291 | (9) | In | 1.5 | 6 | 420 | 10.07 | 2.71 | 1.48 | 6.86 | 4—4 | 10.04 | 2.69 | 1.46 | 6.86 |
| 292 | (9) | In | 1.5 | 6 | 420 | 10.08 | 2.7 | 1.48 | 6.87 | 4—4 | 10.05 | 2.69 | 1.46 | 6.84 |
| 293 | (9) | In | 2.5 | 6 | 420 | 10.07 | 4.52 | 2.46 | 6.83 | 4—4 | 10.05 | 4.5 | 2.44 | 6.84 |
| 294 | (9) | In | 2.5 | 6 | 420 | 10.07 | 4.54 | 2.46 | 6.80 | 4—4 | 10.05 | 4.51 | 2.46 | 6.88 |
| 295 | (9) | In | 2.5 | 6 | 420 | 10.08 | 4.5 | 2.47 | 6.88 | 4—4 | 10.05 | 4.47 | 2.45 | 6.91 |
| 296 | (9) | In | 2.5 | 6 | 420 | 10.06 | 4.55 | 2.5 | 6.91 | 4—4 | 10.05 | 4.53 | 2.48 | 6.90 |
| 297 | (9) | In | 2.5 | 6 | 420 | 10.06 | 4.52 | 2.47 | 6.87 | 4—4 | 10.06 | 4.51 | 2.46 | 6.86 |
| 298 | (9) | In | 2.5 | 6 | 420 | 10.06 | 4.52 | 2.49 | 6.93 | 4—4 | 10.06 | 4.5 | 2.46 | 6.88 |

TABLE 2

| | | Oxidation Resistance | | |
|---|---|---|---|---|
| | Additive Agent | After 96 Hours | After 168 Hours | After 336 Hours |
| Example 1 | In Stearate | No change in color | Slight change in color | Slight change in color |
| Example 2 | In Stearate + Bi | No change in color | Slight change in color | Slight change in color |
| Example 3 | In Stearate + Ni | No change in color | Slight change in color | Slight change in color |
| Example 4 | In Stearate + Co | Slight change in color | Slight change in color | Slight change in color |
| Example 5 | In Stearate + Cu | Slight change in color | Slight change in color | Slight change in color |
| Example 6 | In Stearate + Mn | Slight change in color | Slight change in color | Slight change in color |
| Comparative Example 1 | Zn Stearate | Some change in color | Severe change in color | Severe change in color |
| Comparative Example 2 | Sr Stearate | Severe change in color | Severe change in color | Severe change in color |
| Comparative Example 3 | Ba Stearate | Some change in color | Severe change in color | Severe change in color |
| Comparative Example 4 | Re Stearate | Severe change in color | Severe change in color | Severe change in color |
| Comparative Example 5 | Additive Free | Some change in color | Severe change in color | Severe change in color |

Example 2

Synthesized bismuth stearate (Bi content of 12.0 wt %) was pulverized, and this was put through a sieve to obtain fine powder of 250 meshes or less.

0.4 wt % of this bismuth stearate (abbreviated as "Bi" in Table 3 below), 0.4 wt % of the indium stearate obtained in Example 1 and 1.0 wt % of graphite powder were mixed with the iron powder (Hoganas-made: reduced iron powder). This mixed powder (fill of 1.5 to 2.5 g) was molded into a test piece of approximately 10.05 mmϕ×2.74 to 4.59 mmH under a molding pressure of 6 t/cm$^2$.

In order to judge moldability, details of the relationship and the like of the molding density (GD) and molding pressure of the respective compacts are shown in Table 3 (Sample No. 281 to 288). Further, although the indium soap added together is not indicated in this Table, 0.4 wt % of indium stearate is contained therein.

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 3.

This sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 3

| | | | | | Pressure | Before Sintering | | | | | After Sintering at 1150° C., 1 hr, H2 | | | |
|---|---|---|---|---|---|---|---|---|---|---|---|---|---|---|
| No. | Sample No. | Soap | Fill g | Pressure t · cm−2 | (Device Side) kgf · cm−2 | ϕ mm | t mm | w g | GD g/cc | Sintering Batch | ϕ mm | t mm | w g | SD g/cc |
| 281 | (4) | Bi | 1.5 | 6 | 420 | 10.05 | 2.76 | 1.47 | 6.71 | 4-3 | 10.05 | 2.74 | 1.49 | 6.86 |
| 282 | (4) | Bi | 1.5 | 6 | 420 | 10.08 | 2.74 | 1.47 | 6.72 | 4-3 | 10.05 | 2.7 | 1.49 | 6.96 |
| 283 | (4) | Bi | 2.5 | 6 | 420 | 10.07 | 4.55 | 2.48 | 6.84 | 4-3 | 10.07 | 4.54 | 2.49 | 6.89 |
| 284 | (4) | Bi | 2.5 | 6 | 420 | 10.05 | 4.55 | 2.47 | 6.84 | 4-3 | 10.06 | 4.52 | 2.49 | 6.93 |
| 285 | (4) | Bi | 2.5 | 6 | 420 | 10.05 | 4.55 | 2.47 | 6.84 | 4-3 | 10.07 | 4.54 | 2.5 | 6.91 |
| 286 | (4) | Bi | 2.5 | 6 | 420 | 10.05 | 4.59 | 2.5 | 6.87 | 4-3 | 10.07 | 4.58 | 2.52 | 6.91 |
| 287 | (4) | Bi | 2.5 | 6 | 420 | 10.06 | 4.6 | 2.5 | 6.84 | 4-3 | 10.06 | 4.57 | 2.52 | 6.94 |
| 288 | (4) | Bi | 2.5 | 6 | 420 | 10.07 | 4.59 | 2.5 | 6.84 | 4-3 | 10.07 | 4.57 | 2.51 | 6.90 |

Example 3

Synthesized nickel stearate Pi content of 12.0 wt %) was pulverized, and this was put through a sieve to obtain fine powder of 250 meshes or less.

0.4 wt % of this nickel stearate (abbreviated as "Ni" in Table 4 below), 0.4 wt % of the indium stearate obtained in Example 1 and 1.0 wt % of graphite powder were mixed with the iron powder (Hoganas-made: reduced iron powder). This mixed powder (fill of 1.5 to 2.5 g) was molded into a test piece of approximately 9.93 mmϕ×2.59 to 4.48 mmH under a molding pressure of 6 t/cm$^2$.

In order to judge moldability, details of the relationship and the like of the molding density (GD) and molding pressure of the respective compacts are shown in Table 4 (Sample No. 221 to 228). Further, although the indium soap added together is not indicated in this Table, 0.4 wt % of indium stearate is contained therein.

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 4.

This sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

Moreover, in addition to nickel stearate, the same results were obtained with nickel propionate and nickel naphthenate under the same conditions.

TABLE 4

| | | | | | Pressure | Before Sintering | | | | | After Sintering at 1150° C., 1 hr, H2 | | | |
|---|---|---|---|---|---|---|---|---|---|---|---|---|---|---|
| No. | Sample No. | Soap | Fill g | Pressure t · cm−2 | (Deviceside) kgf · cm−2 | ϕ mm | t mm | w g | GD g/cc | Sintering Batch | ϕ mm | t mm | w g | SD g/cc |
| 221 | (5) | Ni | 1.5 | 6 | 420 | 9.93 | 2.59 | 1.5 | 7.48 | 4-1 | 9.88 | 2.54 | 1.48 | 7.60 |
| 222 | (5) | Ni | 1.5 | 6 | 420 | 9.97 | 2.69 | 1.55 | 7.38 | 4-1 | 9.9 | 2.64 | 1.53 | 7.53 |
| 223 | (5) | Ni | 2.5 | 6 | 420 | 9.94 | 4.44 | 2.5 | 7.26 | 4-1 | 9.89 | 4.43 | 2.48 | 7.29 |
| 224 | (5) | Ni | 2.5 | 6 | 420 | 9.96 | 4.38 | 2.46 | 7.21 | 4-1 | 9.88 | 4.27 | 2.44 | 7.32 |
| 225 | (5) | Ni | 2.5 | 6 | 420 | 9.95 | 4.48 | 2.5 | 7.18 | 4-1 | 9.9 | 4.35 | 2.47 | 7.44 |
| 226 | (5) | Ni | 2.5 | 6 | 420 | 9.96 | 4.39 | 2.45 | 7.16 | 4-1 | 9.9 | 4.31 | 2.45 | 7.38 |
| 227 | (5) | Ni | 2.5 | 6 | 420 | 9.95 | 4.48 | 2.51 | 7.21 | 4-1 | 9.89 | 4.44 | 2.51 | 7.36 |
| 228 | (5) | Ni | 2.5 | 6 | 420 | 9.96 | 4.37 | 2.47 | 7.25 | 4-1 | 9.87 | 4.34 | 2.46 | 7.41 |

Example 4

Synthesized cobalt stearate (Co content of 12.0 wt %) was pulverized, and this was put through a sieve to obtain fine powder of 250 meshes or less.

0.4 wt % of this cobalt stearate (abbreviated as "Co" in Table 5 below), 0.4 wt % of the indium stearate obtained in Example 1 and 1.0 wt % of graphite powder were mixed with the iron powder (Hoganas-made: reduced iron powder). This mixed powder (fill of 1.5 to 2.5 g) was molded into a test piece of approximately 9.96 mm ϕ×2.64 to 4.47 mmH under a molding pressure of 6 t/cm$^2$.

In order to judge moldability, details of the relationship and the like of the molding density (GD) and molding pressure of the respective compacts are shown in Table 5 (Sample No. 231 to 238). Further, although the indium soap added together is not indicated in this Table, 0.4 wt % of indium stearate is contained therein.

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 5.

This sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 5

| | | | | | Pressure | Before Sintering | | | | | After Sintering at 1150° C., 1 hr, H2 | | | |
|---|---|---|---|---|---|---|---|---|---|---|---|---|---|---|
| No. | Sample No. | Soap | Fill g | Pressure t · cm−2 | (Device side) kgf · cm−2 | ϕ mm | t mm | w g | GD g/cc | Sintering Batch | ϕ mm | t mm | w g | SD g/cc |
| 231 | (8) | Co | 1.5 | 6 | 420 | 9.96 | 2.64 | 1.5 | 7.29 | 4-1 | 9.87 | 2.59 | 1.5 | 7.57 |
| 232 | (8) | Co | 1.5 | 6 | 420 | 9.96 | 2.68 | 1.53 | 7.33 | 4-1 | 9.87 | 2.57 | 1.5 | 7.63 |
| 233 | (8) | Co | 2.5 | 6 | 420 | 9.96 | 4.43 | 2.49 | 7.21 | 4-1 | 9.89 | 4.4 | 2.45 | 7.25 |
| 234 | (8) | Co | 2.5 | 6 | 420 | 9.94 | 4.47 | 2.53 | 7.29 | 4-1 | 9.89 | 4.48 | 2.5 | 7.26 |
| 235 | (8) | Co | 2.5 | 6 | 420 | 9.97 | 4.43 | 2.5 | 7.23 | 4-1 | 9.89 | 4.42 | 2.48 | 7.30 |
| 236 | (8) | Co | 2.5 | 6 | 420 | 9.96 | 4.44 | 2.47 | 7.14 | 4-1 | 9.87 | 4.39 | 2.48 | 7.38 |
| 237 | (8) | Co | 2.5 | 6 | 420 | 9.96 | 4.4 | 2.5 | 7.29 | 4-1 | 9.89 | 4.39 | 2.48 | 7.35 |
| 238 | (8) | Co | 2.5 | 6 | 420 | 9.94 | 4.39 | 2.47 | 7.25 | 4-1 | 9.9 | 4.32 | 2.45 | 7.37 |

Example 5

Synthesized copper stearate (Cu content of 12.0 wt %) was pulverized, and this was put through a sieve to obtain fine powder of 250 meshes or less.

0.4 wt % of this copper stearate (abbreviated as "Cu" in Table 6 below), 0.4 wt % of the indium stearate obtained in Example 1 and 1.0 wt % of graphite powder were mixed with the iron powder (Hoganas-made: reduced iron powder). This mixed powder (fill of 1.5 to 2.5 g) was molded into a test piece of approximately 10.05 mm ϕ×2.64 to 4.43 mmH under a molding pressure of 6 t/cm$^2$.

In order to judge moldability, details of the relationship and the like of the molding density (GD) and molding pressure of the respective compacts are shown in Table 6 (Sample No. 261 to 268). Further, although the indium soap added together is not indicated in this Table, 0.4 wt % of indium stearate is contained therein.

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 6.

This sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 6

| | | | | | Pressure | Before Sintering | | | | | After Sintering at 1150° C., 1 hr, H2 | | | |
|---|---|---|---|---|---|---|---|---|---|---|---|---|---|---|
| No. | Sample No. | Soap | Fill g | Pressure t · cm−2 | (Device Side) kgf · cm−2 | ϕ mm | t mm | w g | GD g/cc | Sintering Batch | ϕ mm | t mm | w g | SD g/cc |
| 261 | (6) | Cu | 1.5 | 6 | 420 | 10.05 | 2.69 | 1.47 | 6.89 | 4-2 | 10.04 | 2.62 | 1.45 | 6.99 |
| 262 | (6) | Cu | 1.5 | 6 | 420 | 10.04 | 2.64 | 1.46 | 6.99 | 4-2 | 10.03 | 2.57 | 1.43 | 7.04 |
| 263 | (6) | Cu | 2.5 | 6 | 420 | 10.04 | 4.42 | 2.44 | 6.97 | 4-2 | 10.04 | 4.39 | 2.4 | 6.91 |
| 264 | (6) | Cu | 2.5 | 6 | 420 | 10.05 | 4.43 | 2.45 | 6.97 | 4-2 | 10.04 | 4.41 | 2.41 | 6.92 |
| 265 | (6) | Cu | 2.5 | 6 | 420 | 10.04 | 4.41 | 2.45 | 7.02 | 4-2 | 10.04 | 4.4 | 2.4 | 7.03 |
| 266 | (6) | Cu | 2.5 | 6 | 420 | 10.04 | 4.38 | 2.42 | 6.98 | 4-2 | 10.05 | 4.31 | 2.38 | 6.96 |
| 267 | (6) | Cu | 2.5 | 6 | 420 | 10.06 | 4.34 | 2.4 | 6.96 | 4-2 | 10.03 | 4.29 | 2.36 | 6.96 |
| 268 | (6) | Cu | 2.5 | 6 | 420 | 10.05 | 4.4 | 2.43 | 6.96 | 4-2 | 10.04 | 4.36 | 2.39 | 6.92 |

Example 6

Synthesized manganese stearate (Mn content of 12.0 wt %) was pulverized, and this was put through a sieve to obtain fine powder of 250 meshes or less.

0.4 wt % of this manganese stearate (abbreviated as "Mn" in Table 7 below), 0.4 wt % of the indium stearate obtained in Example 1 and 1.0 wt % of graphite powder were mixed with the iron powder (Hoganas-made: reduced iron powder). This mixed powder (fill of 1.5 to 2.5 g) was molded into a test piece of approximately 10.05 mm ϕ×2.78 to 4.61 mmH under a molding pressure of 6 t/cm$^2$.

In order to judge moldability, details of the relationship and the like of the molding density (GD) and molding pressure of the respective compacts are shown in Table 7 (Sample No. 251 to 258). Further, although the indium soap added together is not indicated in this Table, 0.4 wt % of indium stearate is contained therein.

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 7.

This sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 7

| | | | | | Pressure | Before Sintering | | | | | After Sintering at 1150° C., 1 hr, H2 | | | |
|---|---|---|---|---|---|---|---|---|---|---|---|---|---|---|
| No. | Sample No. | Soap | Fill g | Pressure t · cm−2 | (Device Side) kgf · cm−2 | ϕ mm | t mm | w g | GD g/cc | Sintering Batch | ϕ mm | t mm | w g | SD g/cc |
| 251 | (3) | Mn | 1.5 | 6 | 420 | 10.07 | 2.78 | 1.54 | 6.96 | 4-2 | 10.05 | 2.77 | 1.51 | 6.87 |
| 252 | (3) | Mn | 1.5 | 6 | 420 | 10.07 | 2.78 | 1.53 | 6.91 | 4-2 | 10.03 | 2.76 | 1.51 | 6.92 |
| 253 | (3) | Mn | 2.5 | 6 | 420 | 10.05 | 4.61 | 2.54 | 6.95 | 4-2 | 10.07 | 4.56 | 2.49 | 6.86 |
| 254 | (3) | Mn | 2.5 | 6 | 420 | 10.06 | 4.6 | 2.55 | 6.97 | 4-2 | 10.03 | 4.56 | 2.51 | 6.97 |
| 255 | (3) | Mn | 2.5 | 6 | 420 | 10.04 | 4.59 | 2.53 | 6.96 | 4-2 | 10.04 | 4.56 | 2.48 | 6.82 |
| 256 | (3) | Mn | 2.5 | 6 | 420 | 10.04 | 4.58 | 2.51 | 6.92 | 4-2 | 10.04 | 4.59 | 2.47 | 6.80 |
| 257 | (3) | Mn | 2.5 | 6 | 420 | 10.05 | 4.57 | 2.51 | 6.92 | 4-2 | 10.03 | 4.52 | 2.47 | 6.92 |
| 258 | (3) | Mn | 2.5 | 6 | 420 | 10.04 | 4.57 | 2.5 | 6.91 | 4-2 | 10.04 | 4.53 | 2.47 | 6.89 |

Comparative Example 1

Zinc stearate SZ-2000 (manufactured by Sakai Chemical Industry Co., Ltd.) was used, and, as with Example 1, 0.8 wt % of this zinc stearate (abbreviated as "Zn" in Table 8 below) and 1.0 wt % of graphite powder were mixed with the iron powder. This mixed powder (fill of 1.5 to 2.5 g) was molded into a test piece of approximately 10.04 mm ϕ×2.73 to 4.58 mmH under a molding pressure of 6 t/cm$^2$.

In order to judge moldability, moldability of the mixed powder was evaluated under the same conditions as Example 1 with respect to this test piece. Details of the relationship and the like of the molding density (GD) and molding pressure of the respective compacts are shown in Table 8 (Sample No. 241 to 248).

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 8.

This sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 8

| | | | | | Pressure | Before Sintering | | | | | After Sintering at 1150° C. 1 hr, H2 | | | |
|---|---|---|---|---|---|---|---|---|---|---|---|---|---|---|
| No. | Sample No. | Soap | Fill g | Pressure t · cm−2 | (Device Side) kgf · cm−2 | ϕ mm | t mm | w g | GD g/cc | Sintering Batch | ϕ mm | t mm | w g | SD g/cc |
| 241 | (1) | Zn | 1.5 | 6 | 420 | 10.05 | 2.78 | 1.51 | 6.85 | 4-2 | 10.03 | 2.73 | 1.49 | 6.91 |
| 242 | (1) | Zn | 1.5 | 6 | 420 | 10.04 | 2.73 | 1.51 | 6.99 | 4-2 | 10.04 | 2.71 | 1.49 | 6.94 |
| 243 | (1) | Zn | 2.5 | 6 | 420 | 10.03 | 4.51 | 2.5 | 7.02 | 4-2 | 10.04 | 4.47 | 2.46 | 6.95 |
| 244 | (1) | Zn | 2.5 | 6 | 420 | 10.04 | 4.56 | 2.53 | 7.01 | 4-2 | 10.04 | 4.54 | 2.48 | 6.90 |
| 245 | (1) | Zn | 2.5 | 6 | 420 | 10.04 | 4.5 | 2.5 | 7.02 | 4-2 | 10.03 | 4.47 | 2.45 | 6.94 |
| 246 | (1) | Zn | 2.5 | 6 | 420 | 10.04 | 4.53 | 2.52 | 7.03 | 4-2 | 10.03 | 4.53 | 2.48 | 6.93 |
| 247 | (1) | Zn | 2.5 | 6 | 420 | 10.05 | 4.58 | 2.53 | 6.96 | 4-2 | 10.03 | 4.54 | 2.49 | 6.94 |
| 248 | (1) | Zn | 2.5 | 6 | 420 | 10.05 | 4.52 | 2.5 | 6.97 | 4-2 | 10.04 | 4.47 | 2.46 | 6.95 |

Comparative Example 2

Strontium stearate (Sr) was used, and, as with Example 1, 0.8 wt % of this strontium stearate (abbreviated as "Sr" in Table 9 below) and 1.0 wt % of graphite powder were mixed with the iron powder. This mixed powder (fill of 1.5 to 2.5 g) was molded into a test piece of approximately 10.35 mm ϕ×2.47 to 4.30 mmH under a molding pressure of 5 t/cm$^2$, 6 t/cm$^2$, and 7 t/cm$^2$.

In order to judge moldability, moldability of the mixed powder was evaluated under the same conditions as Example 1 with respect to this test piece. Details of the relationship and the like of the molding density (GD) and molding pressure of the respective compacts are shown in Table 9 (Sample No. 31 to 40).

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 9.

As with Example 1, this sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 9

| No. | Sample No. | Soap | Fill g | Pressure t · cm−2 | ϕ mm | t mm | w g | GD g/cc | ϕ mm | t mm | w g | SD g/cc |
|---|---|---|---|---|---|---|---|---|---|---|---|---|
| 31 | (4) | Sr | 1.5 | 6 | 10.34 | 2.57 | 1.48 | 6.86 | 10.34 | 2.57 | 1.47 | 6.81 |
| 32 | (4) | Sr | 1.5 | 6 | 10.33 | 2.47 | 1.45 | 7.00 | 10.35 | 2.44 | 1.44 | 7.01 |
| 33 | (4) | Sr | 2.5 | 6 | 10.36 | 4.29 | 2.49 | 6.89 | 10.37 | 4.24 | 2.46 | 6.87 |
| 34 | (4) | Sr | 2.5 | 6 | 10.36 | 4.25 | 2.45 | 6.84 | 10.35 | 4.22 | 2.42 | 6.82 |
| 35 | (4) | Sr | 2.5 | 6 | 10.36 | 4.3 | 2.51 | 6.92 | 10.38 | 4.25 | 2.49 | 6.92 |
| 36 | (4) | Sr | 2.5 | 6 | 10.35 | 4.1 | 2.41 | 6.99 | 10.34 | 4.06 | 2.39 | 7.01 |
| 37 | (4) | Sr | 2.5 | 6 | 10.35 | 4.23 | 2.47 | 6.94 | — | — | — | — |
| 38 | (4) | Sr | 2.5 | 6 | 10.35 | 4.22 | 2.46 | 6.93 | — | — | — | — |
| 39 | (4) | Sr | 2.5 | 5 | 10.34 | 4.26 | 2.43 | 6.79 | 10.35 | 4.19 | 2.4 | 6.81 |
| 40 | (4) | Sr | 2.5 | 7 | 10.35 | 4.14 | 2.43 | 6.98 | 10.35 | 4.12 | 2.41 | 6.95 |

Comparative Example 3

Barium stearate (Ba) was used, and, as with Example 1, 0.8 wt % of this barium stearate (abbreviated as "Ba" in Table 10 below) and 1.0 wt % of graphite powder were mixed with the iron powder. This mixed powder (fill of 15 to 2.5 g) was molded into a test piece of approximately 10.35 mm ϕ×2.52 to 4.33 mmH under a molding pressure of 5 t/cm$^2$, 6 t/cm$^2$, and 7 t/cm$^2$. In order to judge moldability, moldability of the mixed powder was evaluated under the same conditions as Example with respect to this test piece. Details of the relationship and the like of the molding density (GD) and molding pressure of the respective compacts are shown in Table 10 (Sample No. 41 to 50).

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 10.

As with Example 1, this sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 10

| No. | Sample No. | Soap | Fill g | Pressure t · cm−2 | ϕ mm | t mm | w g | GD g/cc | ϕ mm | t mm | w g | SD g/cc |
|---|---|---|---|---|---|---|---|---|---|---|---|---|
| 41 | (5) | Ba | 1.5 | 6 | 10.35 | 2.52 | 1.48 | 6.98 | 10.34 | 2.5 | 1.47 | 7.00 |
| 42 | (5) | Ba | 1.5 | 6 | 10.34 | 2.52 | 1.46 | 6.90 | 10.35 | 2.48 | 1.45 | 6.95 |
| 43 | (5) | Ba | 2.5 | 6 | 10.35 | 4.28 | 2.5 | 6.94 | 10.38 | 4.22 | 2.47 | 6.92 |
| 44 | (5) | Ba | 2.5 | 6 | 10.35 | 4.33 | 2.54 | 6.97 | 10.35 | 4.33 | 2.51 | 6.89 |
| 45 | (5) | Ba | 2.5 | 6 | 10.35 | 4.29 | 2.48 | 6.87 | 10.34 | 4.24 | 2.46 | 6.91 |
| 46 | (5) | Ba | 2.5 | 6 | 10.35 | 4.31 | 2.51 | 6.92 | 10.35 | 4.29 | 2.48 | 6.87 |
| 47 | (5) | Ba | 2.5 | 6 | 10.35 | 4.25 | 2.49 | 6.96 | — | — | — | — |
| 48 | (5) | Ba | 2.5 | 6 | 10.35 | 4.22 | 2.47 | 6.96 | — | — | — | — |
| 49 | (5) | Ba | 2.5 | 5 | 10.35 | 4.32 | 2.49 | 6.85 | 10.35 | 4.25 | 2.47 | 6.91 |
| 50 | (5) | Ba | 2.5 | 7 | 10.35 | 4.26 | 2.53 | 7.06 | 10.35 | 4.25 | 2.5 | 6.99 |

Comparative Example 4

Stearic acid (Ce, La, Nd, Pr) (rare earth) was used, and, as with Example 1, 0.8 wt % of this stearic acid (Ce, La, Nd, Pr) (abbreviated as "RE" in Table 11 below) and 1.0 wt % of graphite powder were mixed with the iron powder (Ce 6.2 wt %, La 3.4 wt %, Nd 1.8 wt %, Pr 0.6 wt %). This mixed powder (fill of 1.5 to 2.5 g) was molded into a test piece of approximately 10.35 mm ϕ×2.55 to 4.29 mmH under a molding pressure of 5 t/cm$^2$, 6 t/cm$^2$, and 7 t/cm$^2$. In order to judge moldability, details of the relationship and the like of the molding density (GD) and molding pressure of the respective compacts are shown in Table 11 (Sample No. 51 to 60).

Evaluation on the moldability of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 11.

As with Example 1, this sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 11

| No. | Sample No. | Soap | Fill g | Pressure t · cm−2 | ϕ mm | t mm | w g | GD g/cc | ϕ mm | t mm | w g | SD g/cc |
|---|---|---|---|---|---|---|---|---|---|---|---|---|
| 51 | (6) | RE | 1.5 | 6 | 10.36 | 2.6 | 1.5 | 6.84 | 10.35 | 2.56 | 1.48 | 6.87 |
| 52 | (6) | RE | 1.5 | 6 | 10.35 | 2.55 | 1.48 | 6.90 | 10.36 | 2.53 | 1.47 | 6.89 |
| 53 | (6) | RE | 2.5 | 6 | 10.36 | 4.2 | 2.46 | 6.95 | 10.36 | 4.17 | 2.45 | 6.97 |
| 54 | (6) | RE | 2.5 | 6 | 10.35 | 4.31 | 2.48 | 6.84 | 10.35 | 4.25 | 2.5 | 6.99 |
| 55 | (6) | RE | 2.5 | 6 | 10.36 | 4.2 | 2.47 | 6.98 | 10.34 | 4.16 | 2.45 | 7.01 |
| 56 | (6) | RE | 2.5 | 6 | 10.36 | 4.23 | 2.48 | 6.96 | 10.35 | 4.2 | 2.47 | 6.99 |
| 57 | (6) | RE | 2.5 | 6 | 10.36 | 4.16 | 2.45 | 6.99 | — | — | — | — |
| 58 | (6) | RE | 2.5 | 6 | 10.35 | 4.25 | 2.51 | 7.02 | — | — | — | — |
| 59 | (6) | RE | 2.5 | 5 | 10.35 | 4.29 | 2.47 | 6.84 | 10.34 | 4.25 | 2.46 | 6.89 |
| 60 | (6) | RE | 2.5 | 7 | 10.35 | 4.1 | 2.44 | 7.07 | 10.34 | 4.06 | 2.41 | 7.07 |

Comparative Example 5

Furthermore, additive-free iron powder (Hoganas-made: reduced iron powder (fill of 1.5 to 2.5 g)) was molded into a test piece of approximately 9.96 mm ϕ×2.61 to 4.46 mmH under a molding pressure of 5 t/cm$^2$, 6 t/cm$^2$, and 7 t/cm$^2$. In order to judge moldability, details of the relationship and the like of the molding density (GD) and molding pressure of the respective compacts are shown in Table 12 (Sample No. 301 to 308).

Evaluation on the moldabilty of the mixed powder was conducted with respect to the test piece under the same conditions as Example 1, and, in addition, the compact molded into this test piece was sintered in a batch type atmospheric furnace at a sintering temperature of 1150° C., sintering time of 60 min., and under a hydrogen gas atmosphere. The density (SD) and the like of the sintered body are similarly shown in Table 12.

As with Example 1, this sintered body was set inside a constant temperature and humidity chamber, and an atmospheric exposure test was conducted for 336 hours at a temperature of 40° C. and humidity of 95% in order to conduct a moisture and oxidation resistance experiment. The results of the moisture and oxidation resistance experiment are shown in Table 2.

TABLE 12

| | | | | | Pressure | Before Sintering | | | | | After Sintering at 1150° C., 1 hr, H2 | | | |
|---|---|---|---|---|---|---|---|---|---|---|---|---|---|---|
| No. | Sample No. | Soap | Fill g | Pressure t · cm−2 | (Device Side) kgf · cm−2 | ϕ mm | t mm | w g | GD g/cc | Sintering Batch | ϕ mm | t mm | w g | SD g/cc |
| 301 | (2) | None | 1.5 | 6 | 420 | 10.07 | 2.72 | 1.47 | 6.79 | 4-3 | 10.06 | 2.7 | 1.5 | 6.99 |
| 302 | (2) | None | 1.5 | 6 | 420 | 10.07 | 2.66 | 1.44 | 6.80 | 4-3 | 10.06 | 2.64 | 1.48 | 7.05 |
| 303 | (2) | None | 2.5 | 6 | 420 | 10.08 | 4.38 | 2.44 | 6.98 | 4-3 | 10.05 | 4.37 | 2.46 | 7.10 |
| 304 | (2) | None | 2.5 | 6 | 420 | 10.05 | 4.48 | 2.49 | 7.01 | 4-3 | 10.05 | 4.45 | 2.52 | 7.14 |
| 305 | (2) | None | 2.5 | 6 | 420 | 10.06 | 4.47 | 2.48 | 6.98 | 4-3 | 10.05 | 4.45 | 2.5 | 7.15 |
| 306 | (2) | None | 2.5 | 6 | 420 | 10.05 | 4.42 | 2.44 | 6.96 | 4-3 | 10.05 | 4.41 | 2.46 | 7.03 |
| 307 | (2) | None | 2.5 | 6 | 420 | 10.06 | 4.44 | 2.45 | 6.95 | 4-3 | 10.04 | 4.43 | 2.46 | 7.01 |
| 308 | (2) | None | 2.5 | 6 | 420 | 10.05 | 4.44 | 2.45 | 6.96 | 4-3 | 10.04 | 4.42 | 2.48 | 7.09 |

As evident from Tables 1 to 12, from the evaluation results of compressibility, an approximately even powder density was obtained. Further, the extraction pressure (kg) after molding is shown in Table 13, and the compact of the present invention to which metallic soap has been added has lower extraction pressure in comparison to an additive-free compact, and extraction pressure roughly equivalent to zinc stearate can be obtained.

As described above, Examples 1 to 6 of the present invention to which metallic soap has been added have roughly the same lubricity and moldability as Comparative Example 1 to which a zinc stearate lubricant has been added thereto.

TABLE 13

| | Rustproof Lubricant Material | Extraction Pressure (kg) Molding Pressure 5 ($t/cm^2$) 5 | Molding Pressure 6 ($t/cm^2$) 6 | Molding Pressure 7 ($t/cm^2$) 7 |
|---|---|---|---|---|
| (1) | Zn Stearate | 301 | 384 | 431 |
| (2) | Mn Stearate | 352 | 359 | 363 |
| (3) | Bi Stearate | 316 | 350 | 383 |
| (4) | Ni Stearate | 318 | 377 | 402 |
| (5) | Cu Stearate | 371 | 370 | 364 |
| (6) | Al Stearate | 343 | 361 | 372 |
| (7) | Co Stearate | 322 | 382 | 429 |
| (8) | In Stearate | 345 | 340 | 396 |
| (9) | None | 639 | 812 | 914 |

Next, as evident from Table 2 regarding Comparative Example 5 in which a lubricant was not added to the iron powder, in the moisture resistance and oxidation resistance experiment after sintering, change in color (corrosion) occurred after 96 hours (4 days), and, together with the lapse in time, the degree of change in color increased gradually. The change in color was severe after 336 hours.

Meanwhile, with the strontium stearate of Comparative Example 2, the color changed even more in comparison to the foregoing additive-free Comparative Example 5, and the color changed severely with the lapse in time. Further, with the stearic acid (Ce, La, Nd, Pr) (rare earth) of Comparative Example 4, the color changed severely after 96 hours (4 days). Accordingly, the strontium stearate of Comparative Example 2 and the stearic acid (Ce, La, Nd, Pr) (rare earth) of Comparative Example 4 are not as effective in rust prevention in comparison to the case when no additive is added.

Contrarily, the zinc stearate of Comparative Example 1 and the barium stearate of Comparative Example 3 were approximately equivalent to the additive-free Comparative Example 5 even after the lapse of 336 hours, and it is evident that the addition of zinc stearate and barium stearate has not effect with respect to moisture resistance and oxidation resistance.

Meanwhile, it is clear that each of the Examples 1 to 6 to which the metallic soap has been added thereto according to the present invention only has a slight change in color from the foregoing moisture resistance and oxidation resistance experiment after the lapse of 336 hours, and each of such Examples has moisture resistance and oxidation resistance properties.

Although there is no special description regarding examples of adding aluminum soap, or adding a compound of bismuth soap, nickel soap, cobalt soap, copper soap, manganese soap and aluminum soap to the indium soap, the same results were obtained as with Examples 1 to 6 for each of the foregoing examples.

Accordingly, the mixed powder for powder metallurgy obtained by adding the metallic soap of the present invention to metallic powder for powder metallurgy having iron as its principal component has favorable moldability, and it has been further confirmed that it possesses favorable moisture resistance and oxidation resistance properties.

Further, the electrode potential in a case of employing the indium soap, bismuth soap, manganese soap and zinc soap of the present invention was measured. As the measurement conditions, solution: $0.03MFeSO_4+0.47MK_2SO_4$; pH: 4.56; liquid temperature: 23.1; and reference electrode: SSE (Ag/AgCl) were used.

The result was bismuth addition: −604.73 mV; indium addition: −614.33 mV; manganese addition: −628.93 mV; and zinc addition: −631.87 mV, and the obtained tendency was that higher the potential, the less generation of rust in the environment experiment. This roughly coincides with the trend of the moisture resistance and oxidation resistance after sintering shown in Table 2.

As described above, by employing mixed powder for powder metallurgy obtained by adding the metallic soap of the present invention to metallic powder for powder metallurgy having iron as its principal component, the rustproof effect of sintered bodies such as sintered mechanical components, sintered oil retaining bearings, metal graphite brushes and so can thereby be improved remarkably.

The invention claimed is:

1. Metallic powder for powder metallurgy, comprising a metal powder having iron powder as its principal component and containing indium soap powder, the metallic powder being of a type for molding into a compact and for sintering to produce a sintered body having indium dispersed evenly therein.

2. Metallic powder for powder metallurgy according to claim 1, wherein said metal powder contains at least one additional type of soap selected from the group consisting of bismuth soap, nickel soap, cobalt soap, copper soap, manganese soap and aluminum soap.

3. A rustproof iron-based sintered body prepared by a process comprising the steps of:

adding indium soap to a metallic powder for powder metallurgy to form a mixture, said metallic powder having iron as its principal component, adding at least one additional type of soap selected from the group consisting of bismuth soap, nickel soap, cobalt soap, copper soap, manganese soap and aluminum soap to said metallic powder, and after said adding steps, molding and sintering said mixture to produce the iron-based sintered body which has a structure with indium evenly dispersed therein.

* * * * *

UNITED STATES PATENT AND TRADEMARK OFFICE

CERTIFICATE OF CORRECTION

PATENT NO. : 7,217,310 B2 
APPLICATION NO. : 10/514274
DATED : May 15, 2007
INVENTOR(S) : Masataka Yahagi et al.

It is certified that error appears in the above-identified patent and that said Letters Patent is hereby corrected as shown below:

Column 1, line 9 “components, blushes and” should read --components, brushes and--

Column 4, line 10 “(fill of 15 to 2.5 g)” should read --(fill of 1.5 to 2.5 g)--

Column 4, line 56, Table 2, Example 4, After 96 Hours “Slight change in color” should read --No change in color--

Column 4, line 57, Table 2, Example 5, After 96 Hours “Slight change in color” should read --No change in color--

Column 4, line 58, Table 2, Example 6, After 96 Hours “Slight change in color” should read --No change in color--

Column 6, line 3 “stearate Pi content” should read --stearate (Ni content--

Column 12, line 7 “(fill of 15” should read --(fill of 1.5--

Signed and Sealed this

Eighteenth Day of September, 2007

JON W. DUDAS
*Director of the United States Patent and Trademark Office*